United States Patent [19]

Shewchuk

[11] Patent Number: 4,793,111

[45] Date of Patent: Dec. 27, 1988

[54] THREADED MOUNTING FOR EXTRUDED POLE

[76] Inventor: Peter Shewchuk, 940 Meyerside Drive, Mississauga, Canada, L5T 1R9

[21] Appl. No.: 180,091

[22] Filed: Apr. 11, 1988

[30] Foreign Application Priority Data

Apr. 15, 1987 [CA] Canada ..... 534856

[51] Int. Cl.[4] ..... E02D 27/42

[52] U.S. Cl. ..... 52/298; 52/731; 52/296; 256/59

[58] Field of Search ..... 256/59; 403/344, 381; 52/296, 298, 731

[56] References Cited

U.S. PATENT DOCUMENTS 3,349,538 10/1967 Crossman ..... 52/731
3,506,243 5/1970 Seiler ..... 256/59
3,844,084 10/1974 Hubbard et al. ..... 52/731
3,879,017 5/1975 Maxcy et al. ..... 256/22 X
3,961,452 6/1976 Hubbard et al. ..... 52/731 X

*Primary Examiner*—David A. Scherbel
*Assistant Examiner*—J. Johnson
*Attorney, Agent, or Firm*—Kramer, Brufsky & Cifelli

[57] ABSTRACT

A pole assembly includes an elongate tubular pole releasably locked or held to a base plate. Spaced apart bores are formed in the tubular pole by forming elongate partial bores and closing same with elongate clamp members. The bores so formed are aligned with bores in the base plate to form aligned bore passages each of which houses a spindle. Each spindle is mounted in the tubular pole and a locking device engages each spindle and the base plate to releasably lock the pole to the base plate via the spindles. The assembly has particular utility in the case of an extruded metal pole wherein bores are not readily formed, and additionally overcomes disadvantages associated with the welding of a pole to a base plate.

15 Claims, 3 Drawing Sheets

THREADED MOUNTING FOR EXTRUDED POLE

This invention relates to a pole assembly and its method of manufacture, more especially the invention is concerned with a means for readily mounting an extruded pole on a base plate.

Aluminum pole assemblies are employed for street lighting and typically comprise an extruded elongate, tubular pole and a base plate. A lower end of the pole is welded to the plate and the plate is secured by bolts or the like to the ground.

The weld between the plate and the pole represents the weak point of the assembly with respect to forces acting on the pole.

Generally, it has not been possible to employ just a threaded connection to lock a pole to a base plate, especially in the case of an extruded pole, in view of the difficulty in forming extruded bores in the extrusion operation that can be threaded. The use of a separate boring operation to introduce bores into the extruded pole raises several technical difficulties and increases the cost.

The present invention provides a simple connection between the pole and the plate, which avoids the need for welding and provides a strong connection to accommodate forces on the assembly in use.

In a particular embodiment, the invention employs a connection between complementary threaded members and the invention overcomes the problem of providing a bore in an elongate extruded member.

In accordance with one aspect of the invention an assembly, especially a pole assembly, comprises a tubular member and a plate member releasably locked or held together. The tubular member has a plurality of spaced-apart longitudinal partial first bores integral therewith; and the plate member has a plurality of second bores therein, each second bore being aligned with a partial first bore to form an aligned bore passage. A spindle is housed in each aligned bore passage and extends into the partial first bore and second bore of which it is formed. Means are connected to the tubular member to close the partial first bores to mount each spindle to the tubular member, and a locking means engages each spindle and the plate member to releasably lock or hold the plate member in engagement with the tubular member.

In a preferred embodiment, the tubular member is an elongate, extruded member defining a pole having an extruded tube wall and a plurality of pairs of elongate rib members co-extruded with the wall in which the rib members of each pair and a portion of the wall therebetween are complementary and together form an arcuate race defining a part of one of the first bores. A separately formed clamp member mates with each rib of a pair and is matingly secured thereto, and has a surface complementary to the race to complete a first bore.

In accordance with another aspect of the invention there is provided a method of producing a tubular pole member, particularly for use in the pole assembly of the invention. An elongate tubular member is extruded having a tubular wall and a plurality of spaced-apart pairs of longitudinal rib members, each of the pairs forming an arcuate race defining a portion of a bore. Clamp members profiled to mate with the pairs are fed from a first end into sliding engagement with the pairs for a length which is slightly oversized relative the pairs and are then driven relative to the pairs to mate an undersized portion until the full length of each clamp member mates with a pair. The clamp members have an arcuate surface portion complementary to the arcuate race and in this way a plurality of bores having lengths corresponding to the lengths of the clamp members is formed integral with the tubular wall, whereafter the bores are threaded.

In still another aspect of the invention there is provided a tubular pole member which may be formed in accordance with the afore-mentioned method.

The invention is illustrated in a particular and preferred embodiment by reference to the accompanying drawings in which.

Figure 1A:
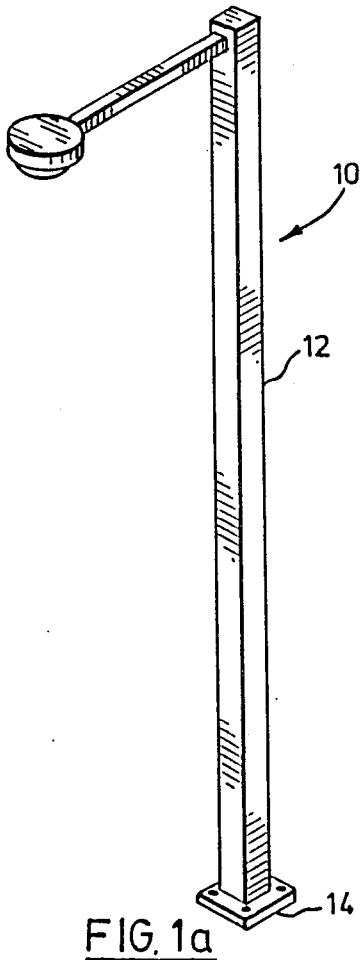
FIG. 1A is a perspective view of a tubular pole assembly in accordance with the invention.
Figure 1B:
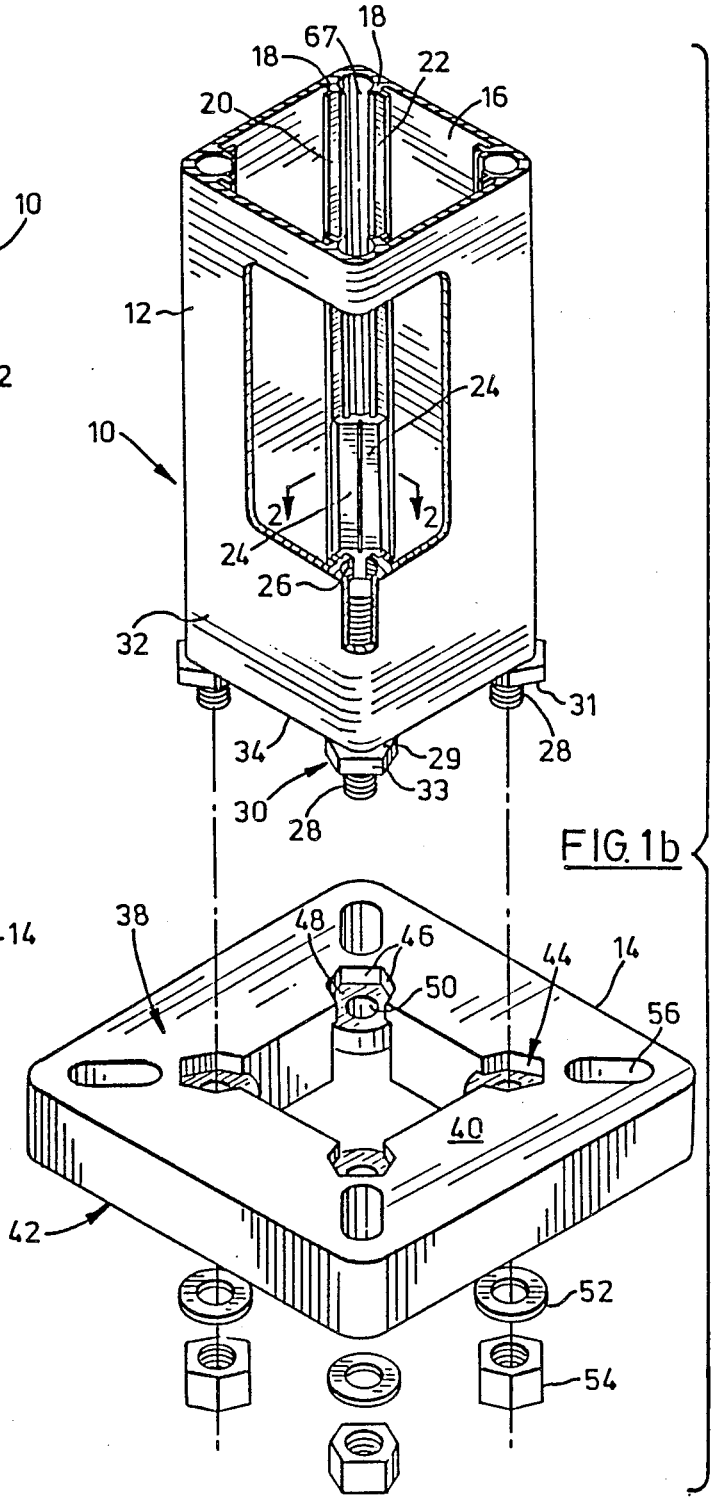
FIG. 1B is a exploded perspective view, partly broken away, of the base of the pole of FIG. 1A.

With reference to FIGS. 1 to 6, a pole assembly 10 comprises a tubular pole 12, suitably extruded of metal, for example, aluminum, and a base plate 14.

Tubular pole 12 has a tubular wall 16 with rib pairs 18 extending transversely or inwardly from the interior of wall 16. Each rib pair 18 comprises complementary elongate ribs 20 and 22.

An elongate clamp member 24 is secured to each rib pair 18, a threaded bore 26 being defined by each rib pair 18, its associated clamp member 24 and a portion of wall 16.

A threaded spindle 28 is threadedly housed in each threaded bore 26 and a nut 30 is threaded on each spindle 28 until it engages an end surface 34 at a lower end 32 of pole 12.

Base plate 14 includes an upper side 38 having a plate surface 40, and a lower side 42.

Recesses 44 defined in plate surface 40 each have facets 46 and a floor 48. A bore 50 extends from each floor 48 to lower side 42. A washer 52 and nut 54 is associated with each bore 50.

Each bore 50 opens at lower side 42 into an enlarged cavity 58 (see FIG. 4) dimensioned to receive washer 52 and nut 54.

Mounting holes 56 extend from upper side 38 to lower side 42 for mounting base plate 14 in the desired location by conventional means such as anchor bolts, (not shown).

Each recess 44 is dimensioned to matingly receive a nut 30. In particular, each nut 30 has an upper wall 29, a lower wall 31 and side walls 33, and is received in a recess 44 so that lower wall 31 engages floor 48 and side walls 33 cooperate with facets 46, and upper wall 29 is essentially flush with plate surface 40.

Figure 2:
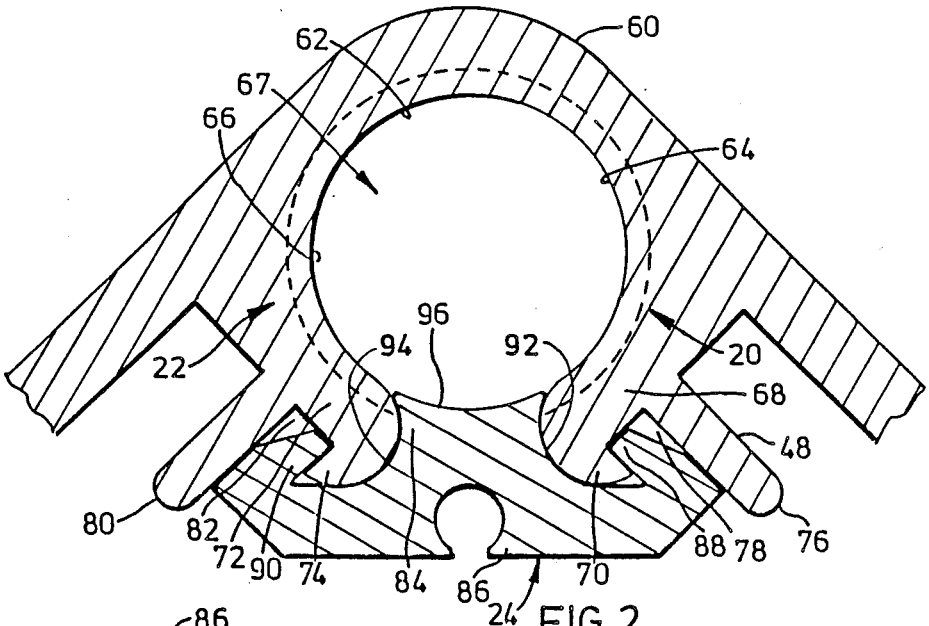
FIG. 2 shows a sectional view of an integral bore of the tubular pole of the pole assembly of FIG. 1 taken along lines 2—2 of FIG. 1.

With particular reference to FIG. 2 there is shown a corner 60 of tubular wall 16 having an arcuate inner surface 62. Rib 20 has a body portion 68 having an arcuate surface 64 and rib 22 has a body portion 72 having an arcuate surface 66. Arcuate surfaces 62, 64 and 66 together form a partial first bore or a race 67.

Body portion 68 terminates in a tongue 70 and body portion 72 terminates in a similar tongue 74. A flange 76 extends from body portion 68 and a channel 78 is defined between flange 76 and tongue 70. Similarly a flange 80 extends from body portion 72 and a channel 82 is defined between tongue 74 and flange 80.

Clamp member 24 has a body 84, a head 86 and ears 88 and 90. A trough 92 is defined between body 84 and ear 88 and a similar trough 94 is defined between body 84 and ear 90.

An arcuate surface 96 is defined in body 84.

Arcuate surfaces 62, 64, 66 and 96 together form the bore of threaded bore 26.

Figure 5:
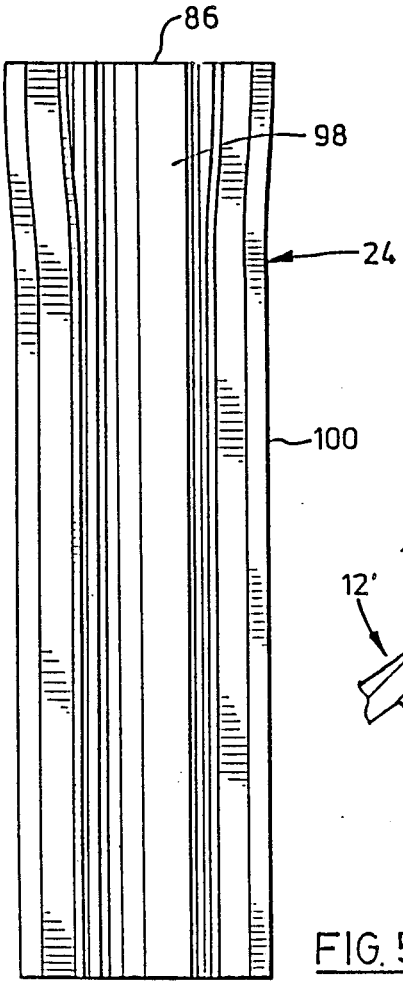
FIG. 5 shows a front elevation of a clamp member of the assembly of FIG. 1, slightly reduced at one end in accordance with a method of the invention, so as to be force-fittingly slid on a pair of ribs as shown in FIG. 2.
Figure 6:
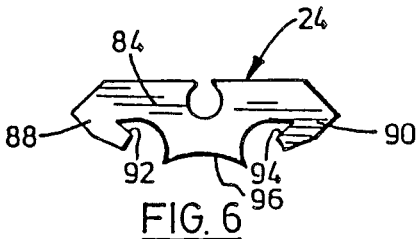
FIG. 6 is a top plan view of the clamp member shown in FIG. 5.

With further reference to FIG. 5, there is shown elongate clamp member 24 with an upper end 98 and a reduced lower end 100. Upper end 98 is dimensioned to freely slide onto a rib pair 18, whereas the reduced lower end 100 must be forcefittingly driven into sliding engagement with rib pair 18.

In operation, tubular wall 16 with rib pairs 18 is formed as a continuous extrusion and cut to an appropriate length to define pole 12.

Elongate clamp member 24 is likewise formed as a continuous extrusion and cut to appropriate lengths and is dimensioned such that originally each clamp member 24 will slide freely on a rib pair 18.

Each clamp member 24 is reduced in cross-sectional dimension at a lower end for approximately $\frac{2}{3}$ $\frac{3}{4}$ of its length, for example, by compressing it, to form a reduced lower end 100 without altering the dimensions of upper end 98. In this way troughs 92 and 94 at upper end 98 can be readily slid onto a rib pair 18 at lower end 32 of tubular wall 16. Thereafter, clamp member 24 is force fittingly driven upwardly so that elongate tongues 70 and 74 are received tightly within reduced troughs 92 and 94 respectively in lower end 100. The reduced troughs 92 and 94 in lower end 100 are dimensioned by the reduction such that tongues 70 and 74 will not freely slide relative to troughs 92 and 94, but on drivingly forcing the clamp member 24 tongues 70 and 74 are force slid into troughs 92 and 94, respectively and tightly engaged therein.

Each clamp member 24 is driven onto a rib pair 18 until such clamp member 24 is fully fitted to a rib pair 18 extending from lower end 32 of wall 16.

The resulting bores which are formed by the respective arcuate surfaces 62, 64, 66 and 96, as defined by reference to FIG. 2 are then threaded to produce the threaded bores 26.

A threaded spindle 28 is then threadedly introduced into each threaded bore 26 so that free ends thereof project from lower end 32 of wall 16. A nut 30 is then threaded on each spindle 28 until upper wall 29 of each nut 30 engages end surface 34 of wall 16 and a free end of spindle 28 extends beyond end surface 34 and nut 30.

The free or projecting ends of spindles 28 are aligned with bores 50 of base plate 14 and nuts 30 are aligned to be matingly received in recesses 44 with lower wall 31 of each nut 30 engaging floor 48 and the facets 46 of each recess 44 cooperating with the side walls 33 of a nut 30, received therein. When a nut 30 is received in a recess 44, upper wall 29 of the nut does not project above plate surface 40, and in particular is generally flush therewith.

The free end of each spindle 28 then extends through a bore 50 into its associated enlarged cavity 58 and a washer 52 is fitted over the end of a spindle 28 in each enlarged cavity 58 and a nut 54 is threaded thereon to engage the floor of cavity 58 and secure pole 12 engaging plate surface 40 of base plate 14.

It will be recognized that at any stage a threaded spindle 28 may be adjusted relative to threaded bore 26 to increase or decrease the projection of the free end thereof to ensure that a sufficient free end or spindle 28 extends into each enlarged cavity 58 for the mounting of a washer 52 and a nut 54, without extending beyond lower side 42 of the plate 14.

The enlarged cavity 58 is of a size sufficient to permit a nut 54 to be tightened on the free end of each spindle 28, to engage the floor of cavity 58.

In the particular embodiment described, the elongate clamp member 24 is reduced at a lower end to leave an upper end 98 as shown in FIG. 5 which will readily slide on a rib pair 18 mounting on the lower end of the rib pair 18. In this regard the clamp member 24 as originally formed is slightly oversized to readily mate with a rib pair 18. It will be evident that in an alternative embodiment the clamp member 24 as a whole could be slightly undersized, and an upper end could be enlarged or expanded so as to readily slide onto a rib pair 18, the undersized lower portion of the clamp necessitating that the clamp member 24 be drivingly forced onto rib pair 18, at such undersized portion to produce essentially the same effect, and a tight fit, as described by reference to the embodiment described by reference to FIG. 2.

A particular advantage is that compression forces at the base of tubular plate 12 are transferred from the threads of spindles 28 housed within the pole to the nuts 30 and then to base plate 14 rather than directly from the bottom of pole 12 to the base plate. This prevents information of the bottom of the pole and loosening of the mounting as may otherwise occur over a long period of time.

Figure 7:
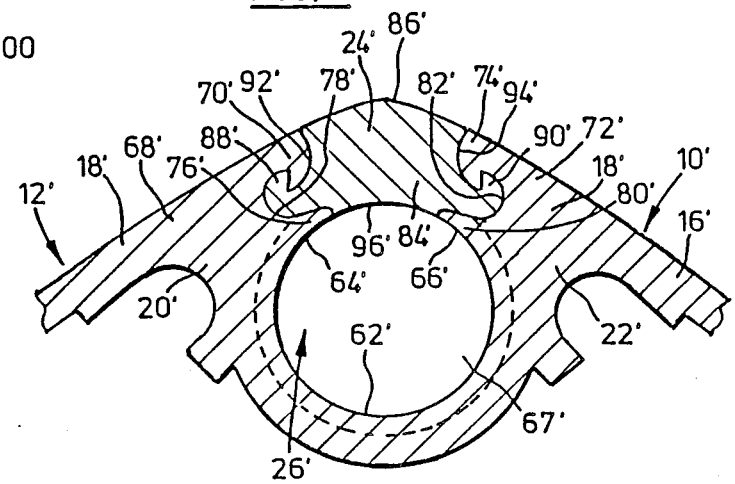
FIG. 7 is a sectional view similar to FIG. 2 showing another embodiment of an integral bore formed in the tubular pole member.
Figure 3:
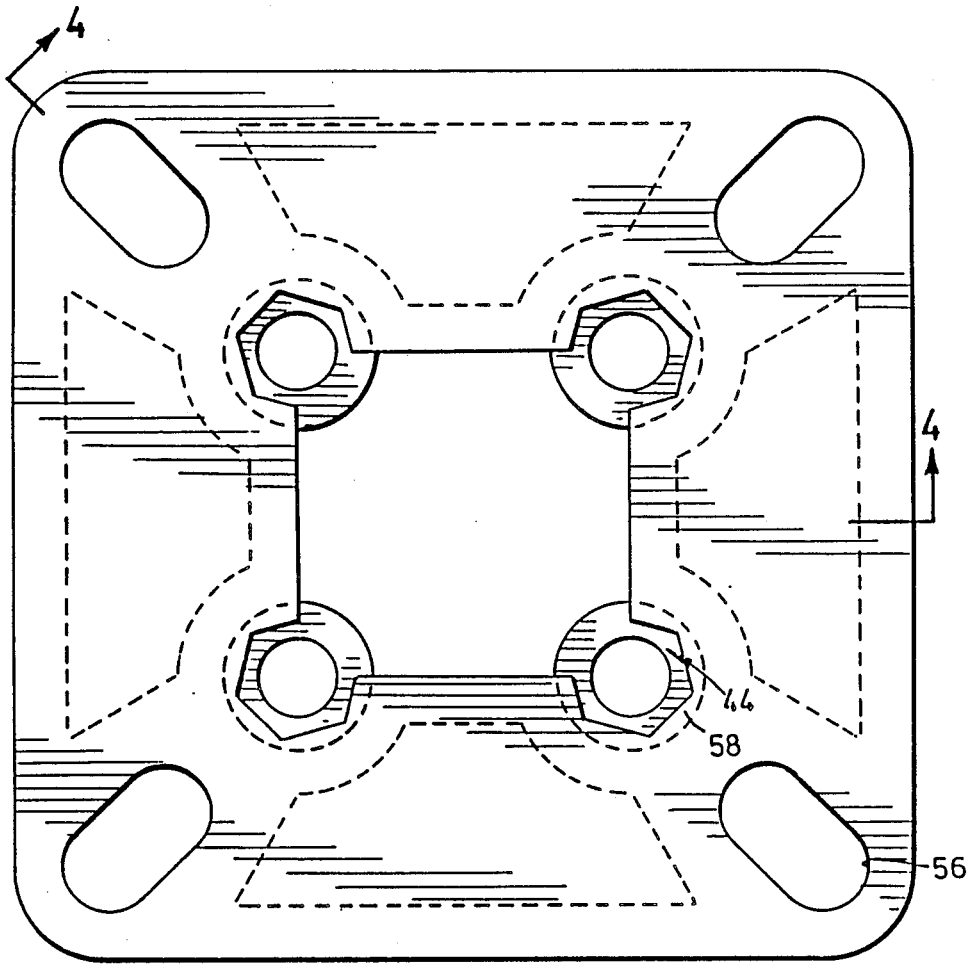
FIG. 3 is a top plan view of the base plate of the assembly of FIG. 1.
Figure 4:
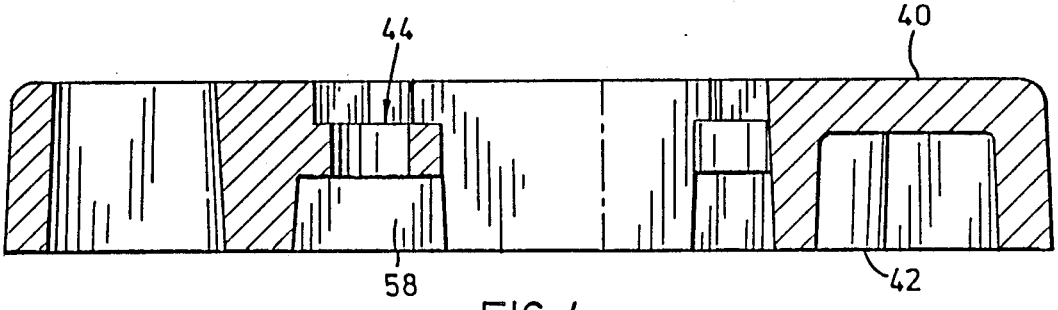
FIG. 4 is an elevational sectional view taken along lines 4—4 of the base plate of FIG. 3.

Referring next FIG. 7, another embodiment of a pole assembly, and in particular the integral bore formed with the clamp member will now be described, primed reference numerals being used to indicate parts similar to the embodiment shown in FIGS. 1 to 6. In this embodiment, rib pairs 18' extend transversely or outwardly of pole 10' to form outwardly opening races 67' Clamp member 24' is thus located on the outside of tubular pole 12 to form part of the outer surface of the pole.

It will be appreciated that races 67' thus form longitudinal grooves the full length of pole 12. Clamp members 24' still only extend part way up into these grooves at the base of the pole. The remainder of the grooves can be left open or closed with suitable filler pieces as desired.

Clamp members 24' can be formed with upper end portions that are reduced cross-sectionally to facilitate insertion into the grooves formed by the rib pairs 18'. Alternatively, rib pairs 18' can be opened slightly at the base of pole 12' for this purpose, with clamp members 24' being of constant cross-section. In all other respects, the embodiment of FIG. 7 is similar to that of FIGS. 1 to 6.

In all embodiments, the length of the spindles 28 can be varied so as to increase or decrease the strength of the base of pole 12. If the spindles are longer (and the associated clamp members), the base of the pole will be stronger and less likely to fail when subjected to high impact forces, such as arise by collision by a vehicle. Conversely, with shorter spindles 28, the base of the pole will be weaker, which may be desirable in some applications. For example, it may be desirable that the pole fail or collapse as a result of the impact, thereby reducing damage to the colliding object, for example, an automobile and its occupants.

Finally, it will be appreciated that the cross-sectional shape of poles 12, 12' could be changed if desired, for example to a round or circular configuration. Further, different types of base plates could be used as well, or perhaps in some applications the base plates could be eliminated altogether, with the poles being bolted directly to some other supporting structure.

The embodiments of the invention in which an exclusive property or privilege is claimed are defined as follows:

1. An assembly comprising:

a tubular member and a plate member releasably locked to said tubular member.

the tubular member having a plurality of spaced-apart longitudinal partial first bores integral therewith;

the plate members having a plurality of second bores therein, each second bore being aligned with a partial first bore of said tubular member, to form an aligned bore passage;

a spindle housed in each aligned bore passage and extending into the partial first bore and second bore thereof;

means connected to the tubular member to close said partial first bores to mount each said spindle to said tubular member; and locking means engaging each said spindle and said plate member such that said plate member is releasably locked to said tubular member.

2. An assembly according to claim 1, wherein said tubular member is an elongate extruded member having an extruded tube wall and a plurality of pairs of elongate rib members co-extruded with said wall, an arcuate race formed between the rib members of each pair defining said partial first bore, and a separately formed elongate clamp member matingly secured to each rib of a pair and complementary to said race to complete the first bore partly defined thereby.

3. An assembly according to claim 2, wherein said first bores and said spindles are in threaded engagement.

4. An assembly according to claim 3, wherein each rib of a pair comprises:

a body terminating in a tongue, a flange extending from said body and spaced from said tongue to define a channel therebetween, and each said clamp member comprises:

a body portion having a head terminating in opposed ears, and a trough defined between said body portion and each ear, each said clamp member being force-fittingly slid on a pair of ribs with a said tongue of each rib of said pair engagingly received in a said trough of said clamp member, and each ear received in a said channel.

5. An assembly comprising:

a tubular member having first and second opposed ends and an inner wall extending between said first and second opposed ends, said first end having an end surface:

said inner wall having a plurality of spaced-apart longitudinal hollow projections extending from said first end to said second end, said projections having threaded bore defined therein adjacent to said first end;

a plurality of threaded spindles, each threaded spindle threadedly engaging a threaded bore and extending outwardly of said first end, a plurality of first nuts, each first nut being threaded on a said threaded sprindle to engage said end surface, with each spindle having a free end projecting beyond the nut threaded thereon, a plate member having an upper side and a lower side, said upper side engaging said end surface, said upper side having a plurality of nut-receiving cavities formed therein, each first nut being matingly housed in a cavity of said plurality, the plate member having bores extending from each cavity to said lower side, each said bore housing a said free end of a said spindle, a plurality of second nuts, each second nut threadedly engaging said spindle at said lower side to lock said plate member and said tubular member together.

6. An assembly according to claim 5, wherein said tubular member is an elongate, extruded pole member, a portion of each said projection being defined by a pair of elongate rib members co-extruded with said wall, the rib members of each pair and a portion of said inner wall therebetween being complementary and together defining a part of a said threaded bore, and a separately formed elongate clamp member secured to each rib of a pair and complementary thereto, and to the portion of said inner wall therebetween to complete the threaded bore partly defined thereby.

7. An assembly according to claim 6, wherein each rib of a pair comprises:

a body terminating in a tongue, a flange extending from said body and spaced from said tongue to define a channel therebetween, and each said clamp member comprises:

a body portion having a head terminating in opposed ears, and a trough defined between said body portion and each ear, each said clamp member being force-fittingly slid on a pair of ribs with a said tongue of each rib of a said pair engagingly received in a said trough of said clamp member, and each ear received in a said channel.

8. A method of producing a tubular pole member for use in a pole assembly comprising:

extruding an elongate tubular member having a tubular wall and a plurality of spaced-apart pairs of longitudinal rib members, each of said pairs forming an arcuate race defining a portion of a bore, providing a plurality of clamp members profiled to mate with said pairs, each clamp member having a first portion extending from a first end slightly oversized relative to said pairs such that it can be freely slid into mating engagement with a said pair, and a second portion extending from said first portion away from said first end, said second portion being slightly undersized relative to said pairs, feeding each clamp member from said first end into sliding engagement with a said pair, driving each said clamp member relative to a said pair to mate said second portion and the full length of each said clamp member with a said pair, each said clamp member having an arcuate surface portion complementary to said race to form a bore having the length of the clamp member, and threading the bores thus formed.

9. A method according to claim 8, wherein said clamp members are extruded with uniform profiled dimensions and including modifying the dimensions of a portion of the clamp members to provide said slightly oversized and undersized portions.

10. A method according to claim 9, wherein the extruded clamp members of uniform profiled dimensions are slightly oversized for their full length and said step of modifying comprises reducing the members cross-sectionally to form the second portions.

11. A method according to claim 10, wherein said pairs of projections comprise elongate ribs, each said race being formed by an arcuate surface of the ribs of a pair and a portion of the tubular wall therebetween.

12. A method according to claim 9, wherein said pairs of projections comprise elongate ribs, each said race being formed by an arcuate surface of the ribs of a pair and a portion of the tubular wall therebetween.

13. A method according to claim 8, wherein said pairs of projections comprise elongate ribs, each said race being formed by an arcuate surface of the ribs of a pair and a portion of the tubular wall therebetween.

14. An extruded pole member for use in a pole assembly comprising:

an elongate, extruded, tubular member having a tubular wall and a plurality of spaced apart pairs of elongated rib members integral therewith, each said pair forming an arcuate race defining a portion of a bore, a plurality of separately formed clamp members, each clamp member being matingly fitted to a said pair and having an arcuate surface portion complementary to said race of said pair to complete said bore, said bore being threaded.

15. A pole member according to claim 14, wherein each said clamp member has an oversized end portion adapted to slide freely relative to a said pair, and an undersized portion force-fitted into engagement with the said pair, whereby said clamp members are tightly held on said pairs.

* * * * *